US005415485A

United States Patent [19]

Marenger

[11] Patent Number: 5,415,485

[45] Date of Patent: May 16, 1995

[54] RIBBON CARTRIDGE RELOADER

[76] Inventor: Michael L. Marenger, 917 Ludington St., Escanaba, Mich. 49829

[21] Appl. No.: 288,773

[22] Filed: Aug. 11, 1994

[51] Int. Cl.[6] ..... B41J 29/00

[52] U.S. Cl. ..... 400/679; 400/692; 400/196.1; 400/197; 400/613; 242/527.7; 226/91; 156/502

[58] Field of Search ..... 400/202.2, 194, 195, 400/196, 196.1, 197, 198, 200, 201, 202, 202.1, 202.4, 613, 692, 693.1, 679, 208; 156/157, 502, 505, 506, 159, 269, 270; 242/526, 527.7, 532.1, 533.1, 538; 118/235; 427/141; 226/91, 92

[56] References Cited

U.S. PATENT DOCUMENTS

| | | | |
|---|---|---|---|
| 3,477,657 | 11/1969 | Norbisrath | 242/419.4 |
| 3,552,670 | 1/1971 | Herman | 242/527.7 X |
| 3,753,834 | 8/1973 | King | 156/506 |
| 4,050,617 | 9/1977 | Biggs et al. | 226/1 |
| 4,240,757 | 12/1980 | Hanna | 400/196.1 |
| 4,367,963 | 1/1983 | Daughters | 400/208 |
| 4,390,294 | 7/1983 | Castro | 400/196.1 |
| 4,397,574 | 8/1983 | Wojdyla | 400/196.1 |
| 4,609,422 | 9/1986 | Becking | 156/502 |
| 4,699,328 | 10/1987 | Kreeft et al. | 242/527.7 |
| 4,772,143 | 9/1988 | Craft et al. | 400/208 |
| 4,854,755 | 8/1989 | Lange et al. | 400/208.1 |
| 4,861,177 | 8/1989 | Heins et al. | 400/208 |
| 4,900,170 | 2/1990 | Beck et al. | 400/196 |
| 4,986,678 | 1/1991 | Hwang | 400/208 |
| 4,990,008 | 2/1991 | Hwang | 400/208 |
| 5,127,750 | 7/1992 | Burgin | 400/208 |
| 5,254,193 | 10/1993 | Carter et al. | 400/194 X |
| 5,310,128 | 5/1994 | Doeberl et al. | 226/91 X |

*Primary Examiner*—Edgar S. Burr
*Assistant Examiner*—Christopher A. Bennett
*Attorney, Agent, or Firm*—Richard C. Litman

[57] ABSTRACT

A ribbon cartridge reloader apparatus which removes spent ribbon from a cartridge and inserts replacement ribbon into the cartridge. The ribbon cartridge reloader includes a discharge motor to pull spent ribbon from a cartridge, at least one infeed motor, interchangeable bits driven by the infeed motor, at least one clamp capable of releasably fastening a ribbon cartridge into the apparatus and urging an external ribbon advance knob of the ribbon cartridge against the interchangeable drive bits, a footage counter, a ribbon tensioner, and a sensor capable of disabling the apparatus when a pre-selected amount of replacement ribbon has been fed into the cartridge.

20 Claims, 5 Drawing Sheets

1
2
3
4
5
6
7
8
9
10
11
12
13
13A
14
15
16
17
18
25
26

RIBBON CARTRIDGE RELOADER

BACKGROUND OF THE INVENTION

1. Field of the Invention

The present invention is directed to an apparatus for loading replacement ribbon into spent ribbon cartridges, wherein the ribbon cartridges come in a wide variety of types and styles which are produced by different manufacturers. The apparatus removes the spent ribbon from the cartridge, and replaces it with new ribbon, thereby effectively recycling the ribbon cartridge. The apparatus will reload both right and left-handed ribbon cartridges of any size, including reel-to-reel type ribbon cartridges and endless loop ribbon cartridges.

2. Description of the Prior Art

Since their earliest introduction, typewriters have used inked ribbons to transfer ink to paper, and these ribbons were replaced when the ink impression formed on the paper became too faint. Replacement of the open ribbon, however, was a messy task because the operator had to handle the exposed and often cumbersome inked ribbon.

Ribbon cartridges were then introduced to make ribbon replacement a less cumbersome and dirty task. Ribbon cartridges are enclosed units containing a supply hub with inked ribbon wrapped around it, with one end of the ribbon attached to a take-up hub. A small section of the ribbon, located between the supply hub and the take-up hub, is situated outside the ribbon cartridge between a discharge opening and a feed opening on the cartridge. In use, the ribbon travels out of the cartridge through the discharge opening, past a printing head or similar impression device, and then reenters the cartridge through the feed opening. Because the cartridge substantially encloses the entire ribbon, the cartridge can be removed from a computer printer or typewriter without exposing the operator to ink stains. Ribbon cartridges are now widely used not only in typewriters, but also in printers for computers, calculators, and other devices where a printed rendering is desired.

A major problem encountered with ribbon cartridges, however, is that once the ribbon enclosed within the cartridge is spent, the entire cartridge must be discarded. This practice is economically acceptable only so long as the costs of raw supplies to produce the cartridge as well as the associated labor and transportation costs remain low. Recent market conditions, including the rising cost of raw materials, labor and transportation, have made ribbon cartridge replacements a relatively expensive office commodity.

Additionally, the spent ribbon cartridges are not easily recycled into different useable products and are therefore normally discarded as refuse. This is an ecologically unsound practice due to the high stability and slow degradation rates of the plastic resins from which the ribbon cartridges are predominately formed.

One attempt to increase the economic feasibility of ribbon cartridges is to produce a cartridge in which new inked ribbon can be manually reloaded into the cartridge, yielding a cartridge which can be reused many times, rather than discarded after only a single use. This solution, however, reintroduces the same problem that ribbon cartridges are intended to solve: The operator is once again exposed to a dirty inked ribbon which is difficult to handle.

Another method to increase the cost effectiveness of ribbon cartridges, which is now being practiced, is to ship the spent cartridges to a commercial facility where the cartridges are refurbished. This, however, is also an added expense which, due to the time and risk involved with shipping, may or may not be economically preferable to simply replacing the entire ribbon cartridge. The cost of shipping the cartridges itself may become prohibitive, or the time consumed in preparing the spent cartridges for shipment may be more costly than the savings realized in having the spent cartridges reloaded with new ribbon.

Additionally, as discussed in more detail below, there are a wide variety of cartridge styles, many of which may be found within a single office. For instance, an office's typewriters may have one or more different styles of ribbon cartridges, while the office's impact printers may add still more and different styles and types of ribbon cartridges. A commercial refurbisher may not be able to handle all the different types of cartridges. This would necessitate sending the cartridges to more than one refurbisher, thereby further complicating the problems involved with shipping and paying for the refurbished cartridges.

Unfortunately, the various manufacturers of typewriters, printers, and related devices have made no attempt to standardize the kinds of cartridges which can be used in their machines. Consequently, there is now an incredibly large diversity of cartridge sizes and dimensions presently available in the market place. These cartridges hold differing amounts of ribbon as well as different types of ribbon. This complicates the process of recycling or refurbishing the cartridges because the widely varying dimensions of the cartridges must be accommodated in order to achieve smooth and automatic reloading of the widest possible variety of cartridge styles. Also, a wide variety of ribbons themselves are currently in commercial use, including inked ribbons in various colors and widths, obliterating correction ribbons, and ink lifting correction ribbons. The presently claimed apparatus to reload ribbon cartridges is capable of handling all of these types of ribbons and is therefore capable of refurbishing a very wide variety of ribbon cartridges.

Even though there are numerous models of ribbon cartridges, all of the cartridges currently in commercial use fall into one of four basic design types. The first type of ribbon cartridge is a reel-to-reel cartridge, which is simply a conventional style typewriter ribbon placed inside a cartridge housing. This type of ribbon cartridge is analogous to a common audio or video tape containing a long length of ribbon having two distinct ends: A supply hub holds the length of ribbon, the ribbon exits the cartridge through a discharge opening, extends past a print head or other impression device, re-enters the cartridge through a feed opening, and is attached to a take-up hub. In use, the ribbon is wound off the supply hub and onto the take-up hub. When all of the ribbon has been transferred to the take-up hub, the cartridge is either discarded, or the direction of tape travel is reversed. In the latter scenario, the take-up hub becomes the supply hub, and vice versa. The ribbon is transferred back and forth between the two hubs until it contains too little ink to produce an acceptable product. At this point, the entire cartridge is discarded. In either instance, the cartridge also includes an external knob or knobs fixed to one or both of the supply or take-up hubs, which knobs can be rotated to advance the ribbon within the cartridge. If the ribbon advancement knob is located on the right-hand side of the cartridge when the cartridge is in its operating position, the cartridge is referred to as a "right-handed" cartridge. If the ribbon advancement knob is located on the left-hand side of the cartridge, the cartridge is designated "left-handed."

The second type of cartridge is an endless loop cartridge in which a length of ribbon is loaded into the cartridge by wrapping it around a plurality of rollers. After being loaded into the cartridge, the ends of the ribbon are spliced together to form an endless loop of ribbon. The ribbon is spliced together to form either an endless loop having both an inside surface and an outside surface, or one end of the ribbon is twisted 180 degrees and then spliced to the other end of the ribbon to form a Mobius band having only one endless surface. This type of cartridge also has an external ribbon advancement knob to advance the ribbon within the cartridge, and the ribbon advancement knob can be located on either the right-hand, or the left-hand side of the cartridge. Thus, these cartridges can be either right-handed or left-handed.

The third type of ribbon cartridge is identical to the second type in all regards except that the ends of the ribbon are spliced together before the ribbon is inserted into the cartridge. Hence, these types of cartridges are referred to as pre-spliced cartridges. This type of cartridge is also of the endless loop variety, and the ribbon can be either a two-surfaced endless loop or a Mobius band. Because the ribbon ends are spliced together prior to inserting the ribbon into the cartridge, these ribbon cartridges require a slightly different procedure for loading new ribbon into the spent cartridge from the procedure for loading ribbon which is spliced after being loaded into the cartridge. This type of cartridge also includes an external ribbon advancement knob for advancing the ribbon within the cartridge, and are found in both right and left-handed versions.

The fourth type of cartridge is identical to the third type of cartridge in all respects except that it lacks an external ribbon advancement knob to advance the ribbon within the cartridge. The ribbon, however, is pre-spliced before loading, and in all other respects the ribbon cartridge functions in an identical manner to the third type described immediately above. Because this type of ribbon does not have an external knob for advancing the ribbon within the cartridge, these cartridges lack "handedness."

The present invention makes the use of ribbon cartridges more economically attractive because the claimed apparatus will quickly and efficiently refurbish any size cartridge of the first, second or third type, in either right or left-handed versions. By refurbish is meant the removal of the spent ribbon from the cartridge and replacement of the spent ribbon with replacement ribbon. The new ribbon may be the same type of ribbon as the old, or may be a different type of ribbon. For instance, the newly loaded ribbon could be a ribbon carrying a different colored ink, or a ribbon of different width, a ribbon made of cloth or plastic film, an ink-lifting resin-coated ribbon instead of an inked ribbon, or an obliterating ribbon for correcting typographical errors, or a combination ink and correction ribbon. These examples are illustrative only, and are not intended to be limiting in any manner. The present invention will reload any type of ribbon capable of being placed inside a given ribbon cartridge.

Ribbon cartridge re-inking machines and refurbishing machines capable of reloading a variety of ribbon cartridges have been described in the prior art. An illustrative example is U.S. Pat. No. 4,390,294, issued Jun. 28, 1983, to Albert J. Castro (Castro). Castro describes a ribbon re-inking machine which is capable of loading a new ribbon into an empty ribbon cartridge. Unlike the present invention, however, the Castro device functions as a re-inking device, and does not include means to remove and discard the spent ribbon from the cartridge.

Another example of a ribbon cartridge loading apparatus is described in U.S. Pat. No. 4,609,422, issued Sep. 2, 1986, to Paul E. Becking (Becking). The apparatus of Becking includes a drive motor for pulling new ribbon into the cartridge, and a supply motor connected to a supply spool to control the rate of delivery of the new ribbon.

Other approaches to simplify or speed the reloading of ribbon cartridges include improved methods of folding the replacement ribbon, or improved cartridges which make the reloading process easier. An example of the first approach is exemplified in U.S. Pat. No. 4,240,757, issued Dec. 23, 1980, to Samuel Y. Hanna (Hanna). The Hanna patent describes an improved fan-fold replacement ribbon package for containing a Mobius band endless ribbon.

A large number of refillable ribbon cartridges per se are known and reflected in the patent literature. A representative sampling of such refillable or reloadable ribbon cartridges is disclosed in the following U.S. patents: Daughters, U.S. Pat. No. 4,367,963; Wojdyla, U.S. Pat. No. 4,397,574; Craft et al, U.S. Pat. No. 4,772,143; Lange et al, U.S. Pat. No. 4,854,755; Heins et al, U.S. Pat. No. 4,861,177; Beck et al, U.S. Pat. No. 4,900,170; Hwang, U.S. Pat. Nos. 4,986,678 and 4,990,008; and Burgin, U.S. Pat. No. 5,127,750.

None of the above-cited references is seen as teaching or fairly suggesting the presently claimed ribbon cartridge reloader.

SUMMARY OF THE INVENTION

The subject invention solves the above problems of the prior art by providing an apparatus which removes spent ribbon from a ribbon cartridge, and replaces it with new ribbon. The apparatus will refurbish both right and left-handed ribbon cartridges of the first, second, and third variety as described above, and will accommodate a wide variety of cartridge structures.

In view of the above discussion, it is an object of the present invention to provide an apparatus which is capable of replacing old ribbon in a ribbon cartridge with new ribbon, regardless of the outside configuration of the cartridge.

It is also an object of the present invention to provide an apparatus to replace ribbon in a ribbon cartridge regardless of whether the cartridge is of the reel-to-reel variety, the endless loop variety, the pre-spliced endless loop variety, or the Mobius band endless loop variety, so long as the ribbon cartridge includes an external ribbon advancement knob.

It is a further object of the present invention to provide an apparatus having at least one new ribbon spindle, each spindle capable of holding different types of ribbon such that different types of ribbons can be easily loaded into different types of ribbon cartridges.

It is yet another object of the present invention to provide an apparatus having at least one idler spindle to facilitate removal of spent ribbon from reel-to-reel type ribbon cartridges.

Yet another object is to provide an apparatus having at least one pre-spliced ribbon canister capable of supplying pre-spliced endless ribbons of the two-sided or Mobius band variety to the claimed ribbon cartridge reloader, said pre-spliced ribbon to be inserted into ribbon cartridges.

Another object of the present invention is to provide an apparatus which removes spent ribbon from ribbon cartridges and inserts replacement ribbon into ribbon cartridges.

Still another object is to provide an apparatus which will refurbish a wide variety of ribbon cartridge styles and types with a minimum of adaptive means necessary to accommodate the varied ribbon cartridge styles and types.

With these and other objects in view, which will become readily apparent upon a reading of the detailed description, below, the invention comprises a ribbon cartridge reloader as hereinafter more fully described, illustrated, and claimed, with reference being made to the attached drawings.

DETAILED DESCRIPTION OF THE PREFERRED EMBODIMENT

Figure 1:
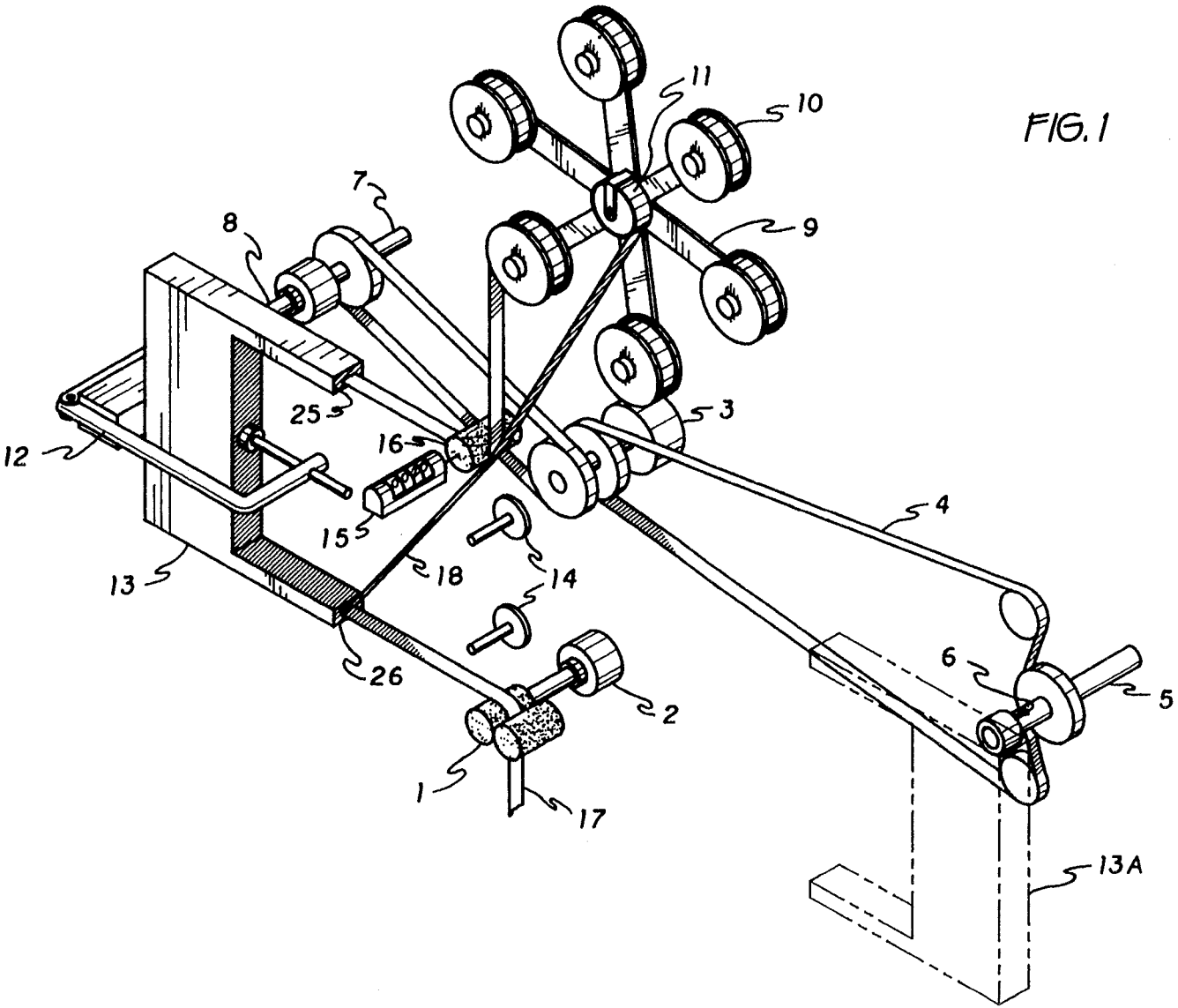
FIG. 1 is an isometric perspective rendering of an embodiment of the claimed ribbon cartridge reloader having one infeed motor and six spindles which hold reels of replacement ribbon.

Reference is made herein to the attached drawings. As far as possible, the same reference numerals are used throughout the various figures to refer to identical or similar features depicted therein.

FIG. 1 depicts an embodiment of the presently ribbon cartridge reloader having one infeed motor 3 powering a left-hand spindle and a right-hand spindle 5 and 7 respectively, via power transmission elements 4. The infeed motor can run on single phase, 120 volt AC power, or DC power. However, if the locality where the apparatus is situated uses a different standard voltage (for instance 220 volts AC), such motors as appropriate could be used. Preferably, the infeed motor is variable speed and reversible, and can operate within a range of from 0 to 2,000 rpm's.

A right-handed ribbon cartridge workpiece 13 is clamped in adjustable clamp 12. A left-handed cartridge **13*a* clamped in adjustable clamp 12*a* is shown in broken lines, revealing left-hand drive bit 6. Right-hand drive bit 8, identical to the left-hand drive bit, is obscured from view by the ribbon cartridge workpiece 13. Left-hand and right-hand interchangeable drive bits are releasably mounted on left-hand and right-hand spindles 5 and 7, respectively, and driven by the infeed motor 3. This mechanism is to draw replacement ribbon 18** into the ribbon cartridge.

The adjustable clamps and interchangeable drive bits cooperate to allow the apparatus to reload all commercially available ribbon cartridges. Using the clamp 12 or **12*a***, the ribbon cartridge is manipulated into a position with its ribbon advancement knob biased against one of the interchangeable drive bits. The drive bits can be made in a range of configurations to efficiently engage the ribbon advancement knob of any particular ribbon cartridge. The drive bits can be easily interchanged to accommodate the differences between cartridges while keeping the amount of apparatus set-up manipulations to a minimum. Such drive bit configurations include screw driver type bits, such as standard flat-head and Phillips-head drive bits, hex-head and Allen drive bits, and star-shaped drive bits. The drive bits can also be sockets which releasably engage the ribbon advancement knob of the ribbon cartridge around its periphery.

A rotatable, releasably fixable spindle turret 9 is shown holding six peripherally mounted replacement ribbon spindles 10. These replacement ribbon spindles hold ribbon to be loaded onto reel-to-reel type cartridges, or endless loop cartridges in which the ribbon ends are spliced together after the ribbon has been loaded into the cartridge. A centrally-mounted pre-spliced ribbon canister 11 is provided for loading pre-spliced replacement ribbons. Any number and combination of replacement ribbon spindles and pre-spliced replacement ribbon canisters may be provided. Preferably, four replacement ribbon spindles and one pre-spliced replacement ribbon canister are provided.

Tensioning and directing means, in the form of capstan 16 is shown for directing the replacement ribbon into the infeed opening 25 of the ribbon cartridge. Any type of tensioning and directing means compatible with the type of replacement ribbon being fed into the cartridge can be used. Such means include the capstan shown, as well as rollers, roller bearings, friction bearings, posts, pulleys, eyelets, drums, or any combination of the above. A measuring device 15, in this instance a mechanical footage counter, is mounted coaxially with capstan 16 to measure the amount of replacement ribbon to be inserted into the cartridge. While a mechanical counter is shown, other measuring means such as electro-optical means, or a timing device synchronized to the speed of the motor can be used.

Spent ribbon 17 is shown being pulled from discharge opening 26 of the cartridge by pull rolls 1. The pull rolls can be separated to facilitate feeding the spent ribbon between the rolls. As noted above for capstan 16, the pull rolls can be of any suitable design so long as they are capable of pulling the spent ribbon from the cartridge. The pulls rolls 1 are drivingly connected to discharge motor 2 for pulling spent ribbon from the cartridge workpiece. In the same manner as the infeed motor, the discharge motor is preferably powered by single phase, 120 volt AC power, or DC power, although different types of motors may be used depending on the standard power source in the locality where the apparatus is used. The discharge motor may also be variable speed, and reversible, and preferably operates within a range of 0 to 500 rpm's.

Idler spindles 14 are shown for mounting reel-to-reel type cartridges for unloading spent ribbon prior to loading replacement ribbon.

Figure 2A:
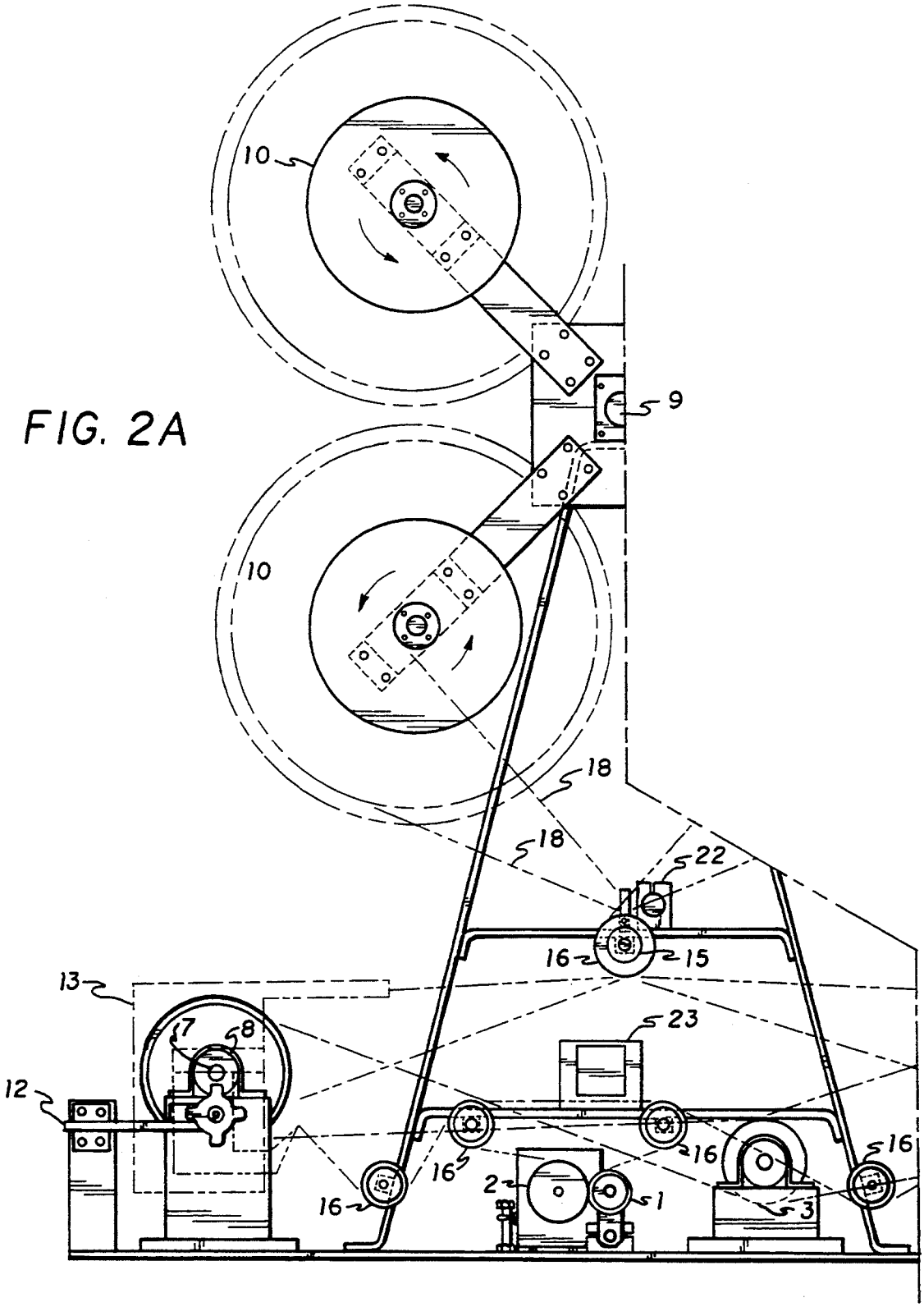
FIGS. 2A and 2B placed side-by-side combine to depict a front elevation view of another claimed embodiment of the ribbon cartridge reloader, this embodiment having only four spindles which hold reels of replacement ribbon.
Figure 2B:
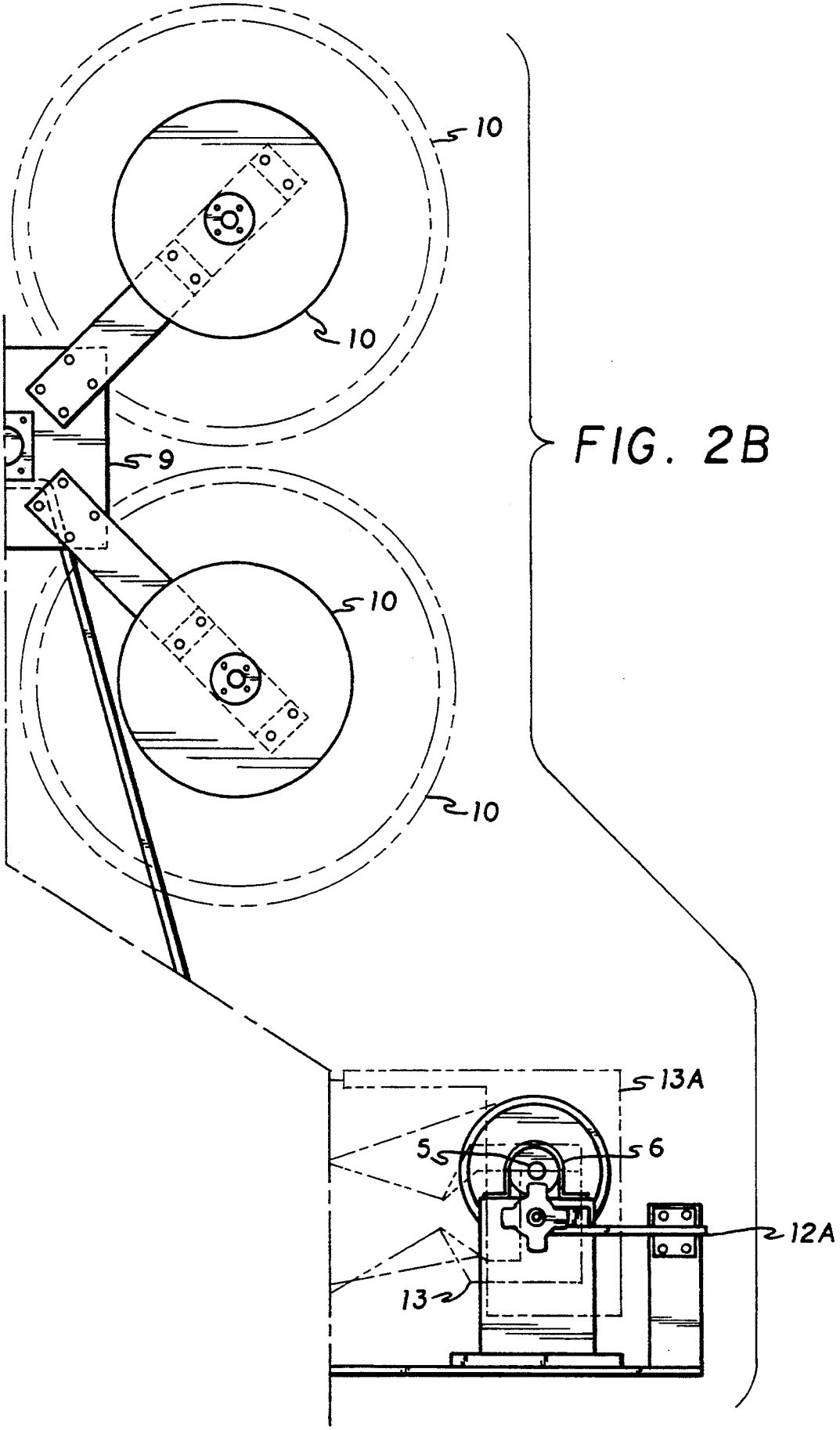

FIGS. 2A and 2B combine to show a partial cut-away front elevation view of another embodiment of the present invention having four spindles on the spindle turret 9. The Figures show all of the spindles holding replacement ribbon spindles 10. However, these positions can also hold pre-spliced ribbon canisters as well.

In addition to the above-identified elements, FIG. 2A depicts additional tensioning and directing means 16 as well as load sensor 22 and unload sensor 23. The load sensor 22 is operationally linked to the measuring means, 15, and is capable of disabling the infeed motor when the measuring means 15 reaches a pre-selected value. The unload sensor 23 is capable of detecting a splice in the ribbon, and will disable the discharge motor 2 when a splice in the ribbon is detected. Both sensors can be mechanical, electromechanical, photoelectric, or stroboscopic.

The entire apparatus is operated by a conventional control panel and associated conventional circuitry (not shown). The controls would include, but not be limited to, such control mechanisms as a manual power control for the various infeed and discharge motors, automatic controls for automating the timing between the two motors and the speed of operation of the motors, as well as an emergency shut-off. The control panel preferably allows the operator to manually or automatically control both the speed and the direction of the infeed and discharge motors.

The apparatus may also include clutch means (not shown), to disable one of the right-hand or left-hand spindles. The clutch could be included as a safety precaution to avoid accidental injury from unnecessarily moving parts.

Figure 3:
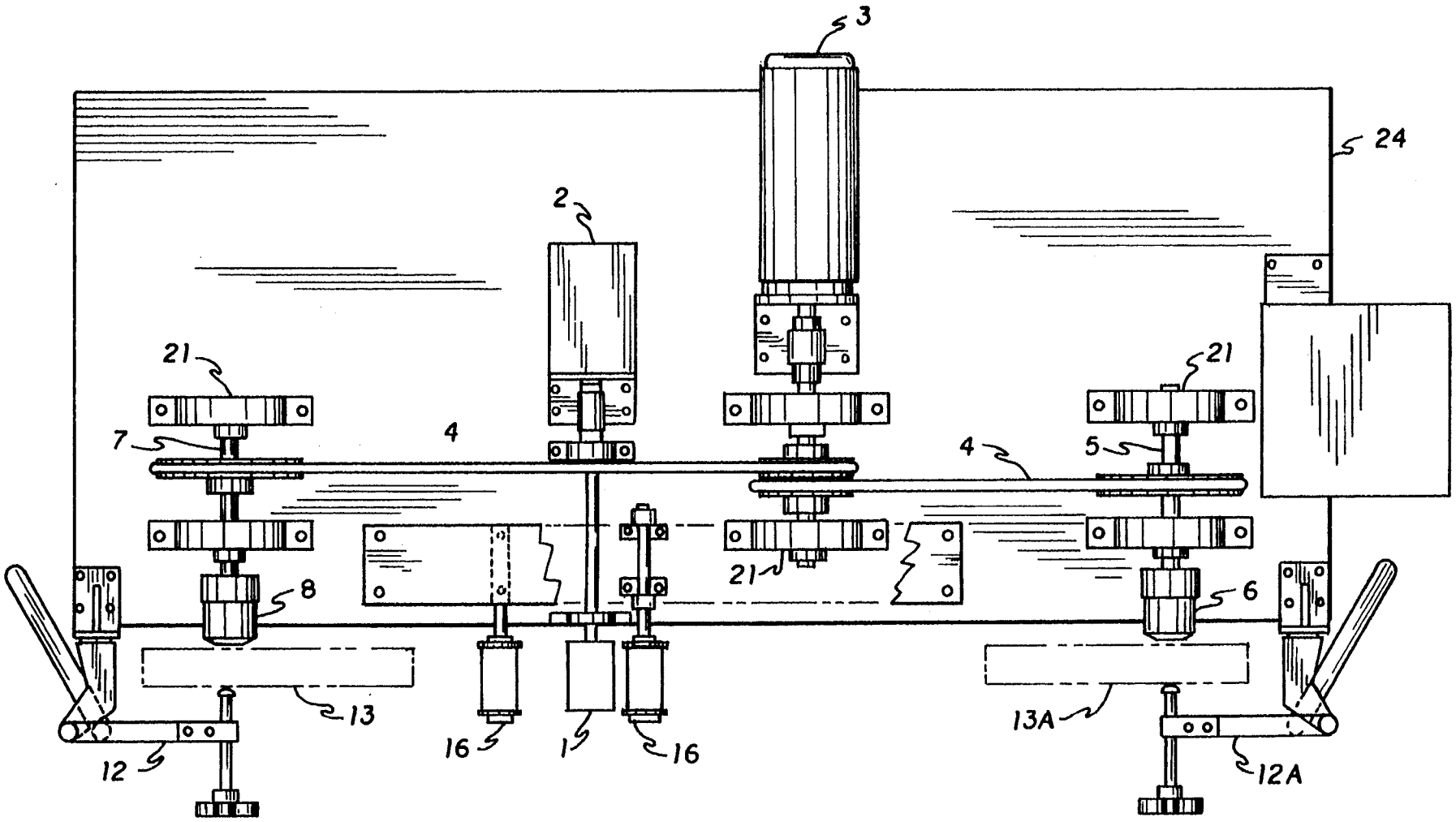
FIG. 3 is a top, partial cut-away view of the embodiment depicted in FIGS. 2A and 2B.

FIG. 3 depicts a top, partial cut-away view of the embodiment shown in FIGS. 2A and 2B, with the entire device mounted on a base, 24. Additionally, various mounting means 21 are shown, which fixedly secure the apparatus to the base.

Figure 4:
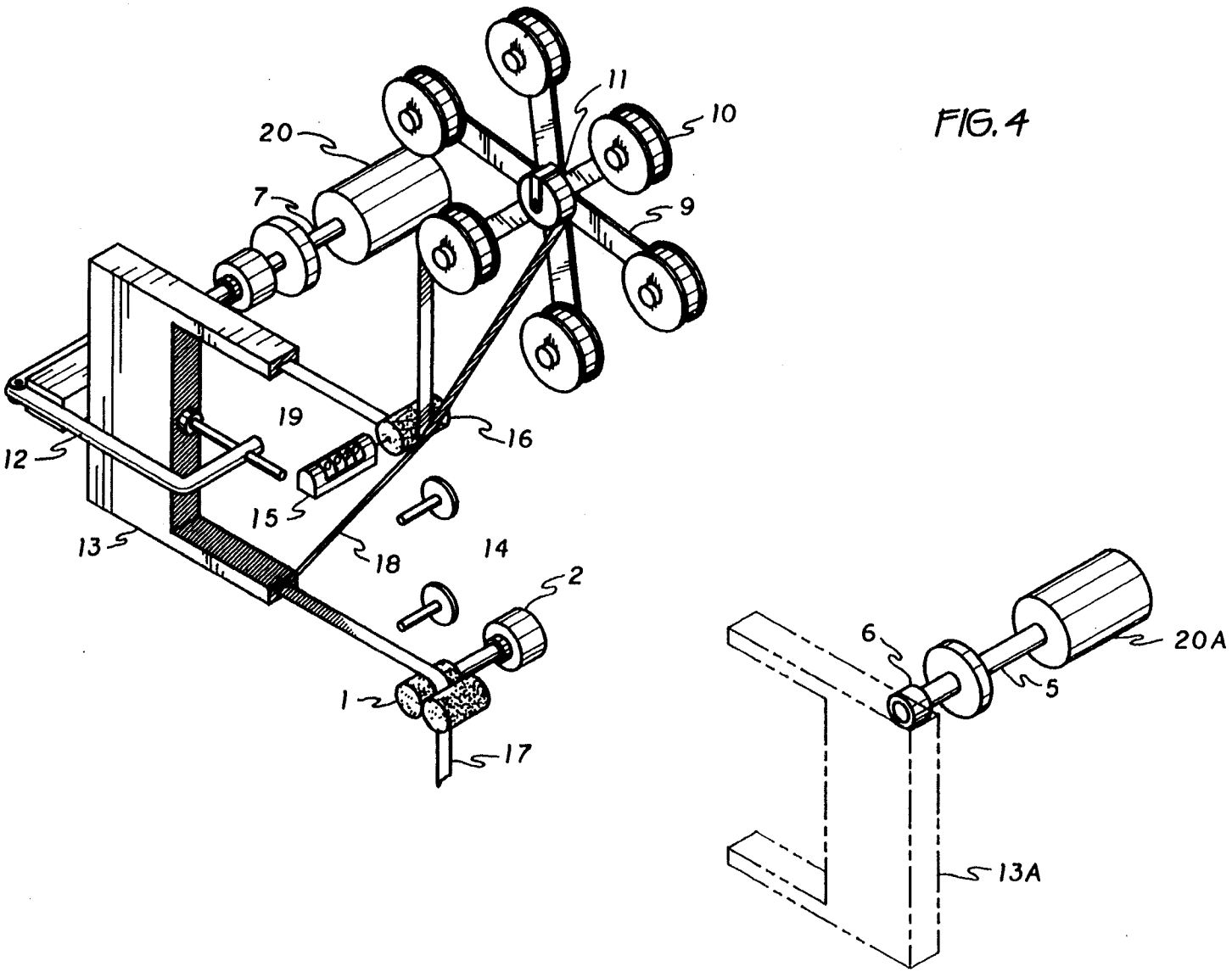
FIG. 4 is an isometric perspective rendering, partially cutaway, of an embodiment of the claimed ribbon cartridge reloader having two independent infeed motors.

FIG. 4 depicts yet another embodiment which includes two independently operated, reversible, direct-drive motors 20 and 20*a*. This embodiment allows greater flexibility in reloading different cartridges with various types of ribbon because the motors can be tuned to operate at different speeds and directions. This can be very helpful when reloading very delicate ribbon, such as correction ribbon, or very long lengths of ribbon. For clarity, tensioning and directing means, as well as sensors, are not shown in FIGS. 1 and 4.

The preferred embodiment of the present cartridge reloading apparatus includes two independently operable, reversible, direct-drive infeed motors, a single discharge motor, and a spindle turret having four replacement ribbon spindles thereon. The preferred embodiment would also include load and unload sensors and ribbon measuring means, described above.

In operation, a ribbon cartridge of the endless loop variety, in which the ends of the ribbon are spliced after the ribbon is loaded into the cartridge, is refurbished in the following manner: First, the cartridge is clamped into the apparatus with clamp 12 if the cartridge is right-handed, or clamp 12*a* if the cartridge is left-handed. The clamp is then adjusted to bias the external ribbon advancement knob of the cartridge against the left-hand or right-hand drive bit, 6 and 8, respectively.

The spent ribbon is then manually cut between the discharge opening and infeed opening of the ribbon cartridge. The pull rolls are opened, and the discharge end of the spent ribbon is fed between the pull rolls, 1. When the ribbon is properly threaded, the pull rolls are again closed. The spindle turret 9 is rotated into position to bring the desired type of replacement ribbon into position for loading. The replacement ribbon is then temporarily spliced to the infeed end of the spent ribbon. The splice 19 is made manually. The splice is preferably made using reflective tape.

The length of the replacement ribbon to be loaded into the cartridge is entered on the counter 15. The machine is then activated.

The discharge motor 2 turns the pull rolls 1 which extracts the spent ribbon from the cartridge. The spent ribbon is collected in a hopper, not shown. At a controlled amount of time after the discharge motor starts, the infeed motor(s) (shown as reference numeral 3 in FIG. 1, and reference numerals 20 and 20*a* in FIG. 4) start turning the drive bits, 6 and 8. The drive bit rotates the ribbon advance knob of the ribbon cartridge workpiece, thereby drawing replacement ribbon into the cartridge. Preferably, both the discharge motor and the infeed motor(s) pull the ribbon at a rate of from 100 to 300 feet per minute.

When all of the spent ribbon is removed from the cartridge, the temporary splice between the spent ribbon and the replacement ribbon is detected by unload sensor, 23. The means for disabling the discharge motor then deactivates the discharge motor.

The infeed motor(s) will continue to draw replacement ribbon into the cartridge until the pre-selected length of ribbon is loaded into the cartridge. Load sensor 22 will then deactivate the infeed motor. This allows the ribbon reloader to insert a greater length of replacement ribbon into the cartridge than was originally contained in the cartridge.

The temporary splice between the spent ribbon and the replacement ribbon is now situated somewhere in the vicinity of the pull rolls, near the discharge opening of the cartridge. The splice is removed from the ribbon. The replacement ribbon is cut near the infeed opening of the cartridge to free the reloaded cartridge from the supply of replacement ribbon located on the spindle turret. The newly loaded cartridge is then removed from the apparatus.

The reloaded cartridge is taken to a different device, where the ends of the ribbon are permanently spliced together to form an endless ribbon loop.

The fully recycled cartridge is then loaded into the apparatus once again, and the infeed motors used to run the new ribbon completely through the cartridge at least once to check the integrity of the permanent splice. Turning the apparatus on and off is accomplished via a control panel, not shown. The refurbished cartridge is now ready to be packaged and shipped.

Pre-spliced endless loop cartridges are refurbished with the present invention using similar steps as above, but variations in the methodology must be made because the replacement ribbon is already spliced into an endless loop prior to being inserted into the ribbon cartridge.

First, the spent cartridge is manually opened, and the spent ribbon removed. A leader portion of the replacement ribbon is threaded through the cartridge, and the cartridge re-sealed. The remainder of the pre-spliced replacement ribbon is then placed on a pre-spliced ribbon canister, 11. The canisters come in different sizes to accommodate different lengths of pre-spliced replacement ribbon.

The cartridge is clamped to the machine as described above, and the apparatus activated manually. When all of the pre-spliced ribbon has been wound off the ribbon canister and into the cartridge, the apparatus is manually deactivated. The refurbished cartridge is removed from the machine, packaged and shipped.

Reel-to-reel cartridge types are reloaded using the idler spindles, 14. The spent reel-to-reel cartridge is loaded into the reloader by mounting it on the idler spindles. As described above, the spent ribbon is fed through the pull rolls, 1. The discharge motor is then activated to remove the spent ribbon from the cartridge.

The now-empty cartridge is removed from the idler spindles and clamped into one of the clamps so that one of the reels of the cartridge is biased against one of the drive bits. The spindle turret is then rotated and locked into position so that the desired type of replacement ribbon can be inserted into the empty cartridge. The end of the replacement ribbon is fed through the measuring sensor 15 the tensioning devices 16, and attached to the reel mounted to one of the drive bits.

The desired length of replacement ribbon to be inserted into the cartridge is entered on the footage counter. The infeed motor(s) is then activated, which draws the replacement ribbon into the cartridge. When the pre-selected length of ribbon has been drawn, the sensor means deactivates the apparatus.

The replacement ribbon is then cut to free the cartridge from the spindle turret. The free end of the replacement ribbon is manually fastened to the other reel of the cartridge using reflective or some other type of tape. The fully refurbished cartridge is now ready to be shipped.

It is to be understood that the present invention is not limited to the embodiments described above, but encompasses any and all embodiments within the scope of the following claims.

I claim:

1. A ribbon cartridge reloader comprising:

at least one infeed motor;

a left-hand spindle and a right-hand spindle;

power transmitting elements operationally connecting said at least one infeed motor to said left-hand spindle and said right-hand spindle;

a left-hand drive bit releasably engaged to and rotatably driven by said left-hand spindle;

a right-hand drive bit releasably engaged to and rotatably driven by said right-hand spindle;

at least one adjustable clamp, said adjustable clamp capable of releasably fastening a ribbon cartridge workpiece such that a ribbon advancement knob of the ribbon cartridge is releasably biased against said left-hand drive bit when the ribbon cartridge is left-handed and said right-hand drive bit when the ribbon cartridge is right-handed;

a rotatable spindle turret having at least one replacement ribbon spindle thereon, said replacement ribbon spindle capable of supplying replacement ribbon to said ribbon cartridge reloader;

a discharge motor;

at least one pull roll; and power transmitting elements operationally connecting said discharge motor to said at least one pull roll;

wherein said at least one pull roll is capable of removing spent ribbon from the ribbon cartridge workpiece; and wherein said at least one infeed motor rotates said left-hand and said right-hand drive bits, whereby the replacement ribbon is drawn into the ribbon cartridge workpiece.

2. The ribbon cartridge reloader according to claim 1, further comprising at least one idler spindle.

3. The ribbon cartridge reloader according to claim 2, wherein said at least one idler spindle is two idler spindles.

4. The ribbon cartridge reloader according to claim 3, further comprising at least one pre-spliced ribbon canister mounted on said spindle turret, said pre-spliced ribbon canister capable of supplying pre-spliced replacement ribbon to said ribbon cartridge reloader.

5. The ribbon cartridge reloader according to claim 4, wherein said pre-spliced ribbon canister is capable of supplying pre-spliced ribbon selected from the group consisting of two-sided endless loop ribbon, and one-surfaced Mobius band endless ribbon.

6. The ribbon cartridge reloader according to claim 5, further comprising at least one sensor, said at least one sensor capable of detecting a splice between the spent ribbon and the replacement ribbon.

7. The ribbon cartridge reloader according to claim 6, further comprising a means for measuring a pre-selected length of replacement tape to be inserted into the ribbon cartridge workpiece.

8. The ribbon cartridge reloader according to claim 7, further comprising means for disabling operation of said discharge motor, said means for disabling said discharge motor responsive to said at least one sensor capable of detecting a splice between the spent ribbon and the replacement ribbon.

9. The ribbon cartridge reloader according to claim 8, wherein said at least one sensor is a load sensor and an unload sensor, said load sensor and said unload sensor capable of detecting a splice between the spent ribbon and the replacement ribbon.

10. The ribbon cartridge reloader according to claim 9, wherein said load sensor and said unload sensor are photoelectric sensors, and wherein said load sensor further includes means for disabling said at least one infeed motor, said means for disabling said at least one infeed motor responsive to said means for measuring a pre-selected length of replacement ribbon.

11. The ribbon cartridge reloader according to claim 9, further comprising at least one means for guiding and tensioning the spent ribbon removed from the ribbon cartridge workpiece, and at least one means for guiding and tensioning the replacement ribbon inserted into the ribbon cartridge workpiece.

12. The ribbon cartridge reloader according to claim 11, wherein said at least one means for guiding and tensioning the spent ribbon, and said at least one means for guiding and tensioning the replacement ribbon are selected from the group consisting of capstans, pulleys, rollers, roller bearings, eyelets, posts, drums, pipes, and combinations thereof.

13. The ribbon cartridge reloader according to claim 11, wherein said at least one replacement ribbon spindle on said spindle turret is four replacement ribbon spindles.

14. The ribbon cartridge reloader according to claim 11, wherein said at least one replacement ribbon spindle on said spindle turret is six replacement ribbon spindles.

15. The ribbon cartridge reloader according to claim 11, wherein said at least one infeed motor is a left-hand infeed motor and a right-hand infeed motor, said left-hand infeed motor operationally connected to said left-hand spindle, and said right hand infeed motor operationally connected to said right-hand spindle, wherein both of said left-hand infeed motor and said right-hand infeed motor are reversible.

16. The ribbon cartridge reloader according to claim 11, wherein said at least one adjustable clamp is a left-hand clamp and a right-hand clamp, said left-hand clamp being capable of releasably fastening a left-handed ribbon cartridge workpiece such that a ribbon advancement knob of the left-handed ribbon cartridge workpiece is releasably biased against said left-hand drive bit, and said right-hand clamp being capable of releasably fastening a right-handed ribbon cartridge workpiece such that a ribbon advancement knob of the right-handed ribbon cartridge workpiece is releasably biased against said right-hand drive bit.

17. A ribbon cartridge reloader for removing spent ribbon from a ribbon cartridge workpiece and inserting replacement ribbon therein, said ribbon cartridge workpiece having an external ribbon advancement knob, said ribbon cartridge reloader comprising:

two direct-drive infeed motors;

a left-hand spindle and a right-hand spindle, one of said direct-drive infeed motors operationally connected to said left-hand drive spindle, and the other of said direct-drive infeed motors operationally connected to said right-hand spindle;

a left-hand drive bit and a right-hand drive bit, said left-hand drive bit releasably engaged to and rotatably driven by said left-hand spindle, and said right-hand drive bit releasably engaged to and rotatably driven by said right-hand spindle;

a left-hand adjustable clamp and a right-hand adjustable clamp, said left-hand adjustable clamp being capable of releasably fastening a left-handed ribbon cartridge workpiece such that a ribbon advancement knob of the ribbon cartridge workpiece is releasably biased against said left-hand drive bit, and said right-hand adjustable clamp being capable of releasably fastening a right-handed ribbon cartridge workpiece such that a ribbon advancement knob of the ribbon cartridge workpiece is releasably biased against said right-hand drive bit;

a rotatable spindle turret having at least one replacement ribbon spindle and at least one pre-spliced ribbon canister mounted thereon;

at least two idler spindles;

a load sensor and an unload sensor, said load sensor and said unload sensor capable of detecting a splice between the spent ribbon and the replacement ribbon;

means for measuring a pre-selected length of replacement ribbon to be inserted into the ribbon cartridge workpiece;

means for disabling operation of said ribbon cartridge reloader, said means for disabling said ribbon cartridge reloader responsive to said means for measuring the pre-selected length of replacement tape;

a discharge motor;

at least one pull roll; and power transmitting elements operationally connecting said discharge motor to said at least one pull roll;

wherein said at least one pull roll is capable of removing spent ribbon from the ribbon cartridge workpiece; and wherein said left-hand and said right-hand infeed motors rotate said left-hand and said right-hand drive bits, respectively and independently of one another, whereby the replacement ribbon is drawn into the ribbon cartridge workpiece.

18. The ribbon cartridge reloader according to claim 17, further comprising at least one means for guiding and tensioning the replacement ribbon inserted into the ribbon cartridge workpiece, said guiding and tensioning means located adjacent to and coaxially with said means for measuring a pre-selected length of replacement ribbon.

19. The ribbon cartridge reloader according to claims 18, wherein said load sensor and said unload sensor are photoelectric sensors.

20. The ribbon cartridge reloader according to claim 19, wherein said at least-one replacement ribbon spindle on said spindle turret is four replacement ribbon spindles.

* * * * *